US007621055B1

(12) United States Patent
Brooks

(10) Patent No.: US 7,621,055 B1
(45) Date of Patent: Nov. 24, 2009

(54) STRING MOUNTED PEEP SIGHT FOR ARCHERY

(76) Inventor: Ernest Brooks, 3111 Rocky River Rd., Omak, WA (US) 98841

( * ) Notice: Subject to any disclaimer, the term of this patent is extended or adjusted under 35 U.S.C. 154(b) by 0 days.

(21) Appl. No.: 12/236,398

(22) Filed: Sep. 23, 2008

(51) Int. Cl.
*F41G 1/467* (2006.01)

(52) U.S. Cl. ..... 33/265; 124/87; 124/90

(58) Field of Classification Search ..... 33/265; 124/86–88, 90–92
See application file for complete search history.

(56) References Cited

U.S. PATENT DOCUMENTS

| | | | | | |
|---|---|---|---|---|---|
| 3,703,770 | A * | 11/1972 | Sofield | 33/265 |
| 4,656,746 | A * | 4/1987 | Gillespie | 33/265 |
| 4,656,994 | A * | 4/1987 | Jenks | 124/87 |
| 4,833,786 | A * | 5/1989 | Shores, Sr. | 33/265 |
| 4,860,458 | A * | 8/1989 | Ernstsen | 33/265 |
| 5,107,596 | A * | 4/1992 | Snyder | 33/265 |
| 5,697,357 | A * | 12/1997 | Chipman | 124/87 |
| 5,850,700 | A * | 12/1998 | Capson et al. | 33/265 |
| 6,170,164 | B1 * | 1/2001 | Knowles | 33/265 |
| 2003/0019118 | A1 * | 1/2003 | Wilson | 33/265 |

* cited by examiner

*Primary Examiner*—Yaritza Guadalupe-McCall
(74) *Attorney, Agent, or Firm*—David L. Tingey

(57) ABSTRACT

A peep site as a sighting mechanism for an archery bow and arrow slidably mounts on an archery bow string. The peep site is self-aligning with an elastic string anchored between the peep site and an archery bow that pulls the peep site forward toward the bow when the bow string is stretched. The mount has a slot between the hole on one mount end and the other mount end to which the elastic string attaches. To install the mount the bow string is inserted through the slot and into the hole. The slot is then closed, either by one end of the elastic string looped around the mount or by a plug secured to the mount. A member with a peep hole extends from the mount such that when the mount is forward aligned and located on the bow string at a preferred position, the peep hole is in a natural, or convenient, location for the user to view a target through the peep hole. To locate the mount on the bow string at the preferred position a clip is secured firmly on the bow string. In use then, when the bow string is pulled into a cocked position, the mount slides upward into abutment with the clip at the preferred position and into forward alignment such that the peep hole is in the convenient location for the user to view the target through the peep hole.

20 Claims, 5 Drawing Sheets

STRING MOUNTED PEEP SIGHT FOR ARCHERY

BACKGROUND

1. Field of the Invention

This invention relates to sighting mechanisms for archery bows, and more particularly to a peep site slidably mounted a bow string.

2. Prior Art

There are a number of sighting mechanisms for archery bows known in the art. However, there is not previously known a self-aligning sighting mechanism slidably mounted on the bow string.

It is therefore the object of the present invention to provide a sighting mechanism mounted on the bow string. It is still another object that the sighting mechanism be slidably mounted. It is still another object that the sighting mechanism be self-aligning.

SUMMARY

These objects are achieved in a peep site as a sighting mechanism slidably mounted on an archery bow string. The peep site is self-aligning with an elastic string anchored between the peep site and an archery bow that pulls the peep site forward toward the bow when the bow string is stretched. Because the peep site is slidably mounted, that is, without restriction to the movement of the peep site along the bow string, it is also free to rotate and slide on the bow string into forward alignment without any action by a user. (Actually, the peep site is mounted around the bow string with the bow string passing without restriction though a hole in the peep site mount. For ease of description, for all purposes herein use of the term "slidably" or "slidable" is meant to include this described way of mounting the peep site to the bow string without restriction to movement of the peep site along the bow string and all other ways of securing the mount to the bow string without restriction to the movement of the peep site along the bow string.)

The peep site comprises primarily a mount with a mount hole larger in diameter than the cross section of the bow string through which mount hole the bow string passes. The mount has a slot between the mount hole on one mount end and the other mount end to which the elastic string attaches. To install the mount around the bow string, the bow string is inserted through the slot to the mount hole. (It is recognized that the mount hole may simply be the slot itself or the limit of the slot at the mount first end. It is also recognized that reference to a mount hole is unnecessary as the bow string may simply be inserted into the slot and then slot can be closed. It is also recognized that the slot may be at a mount first end and the elastic string may be attached to the mount second end with the bow string passing through the mount intermediate the mount. These and various other structures can be used to secure the mount slidably to the bow string. Because it would be an exhaustive effort to attempt to describe all such variations, for all purposes herein, the mount hole is meant only to be that portion of the mount through which the bow string passes, even if in fact it is only the slot itself, and further the particular description given herein is meant to represent and include all such structures as being equivalent to the particular structure described and illustrated.) The slot is then closed, either by one end of the elastic string looped around the mount or by a plug secured to the mount. A member with a peep hole extends from the mount such that when the mount is forward aligned and located on the bow string at a preferred position, the peep hole is in a natural, or convenient, location for the user to view a target through the peep hole.

To locate the mount on the bow string at the preferred position a clip is secured firmly, that is, not slidably, on the bow string with a clamping force that prevents it from sliding. In use then, when the bow string is pulled into a cocked position, the mount slides upward into abutment with the clip at the preferred position and into forward alignment such that the peep hole is in a convenient location for the user to view the target through the peep hole.

DETAILED DESCRIPTION OF THE PREFERRED EMBODIMENT

Figure 1:
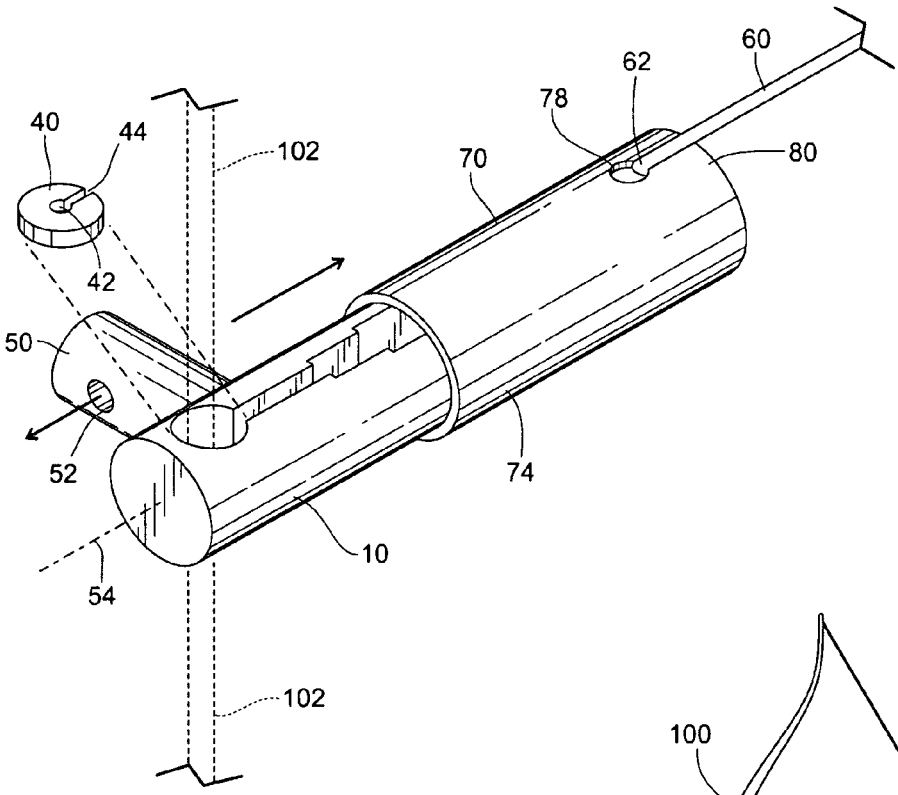
FIG. 1 is a perspective view of a peep sight for an archery bow and arrow according to the present invention, including an elastic string between the bow and the bow string with the peep site mounted on the bow string.
Figure 2:
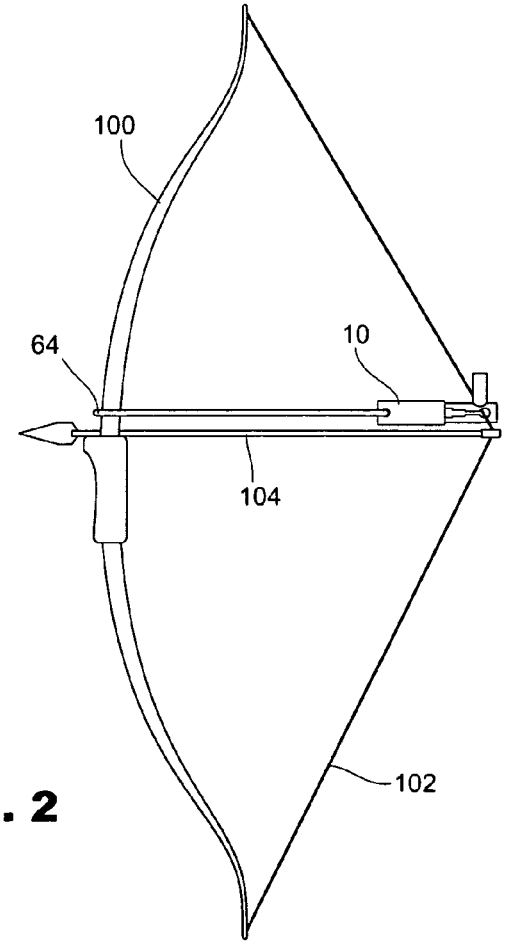
FIG. 2 is a side view of the peep sight of FIG. 1 in use on a bow with an arrow.
Figure 3:
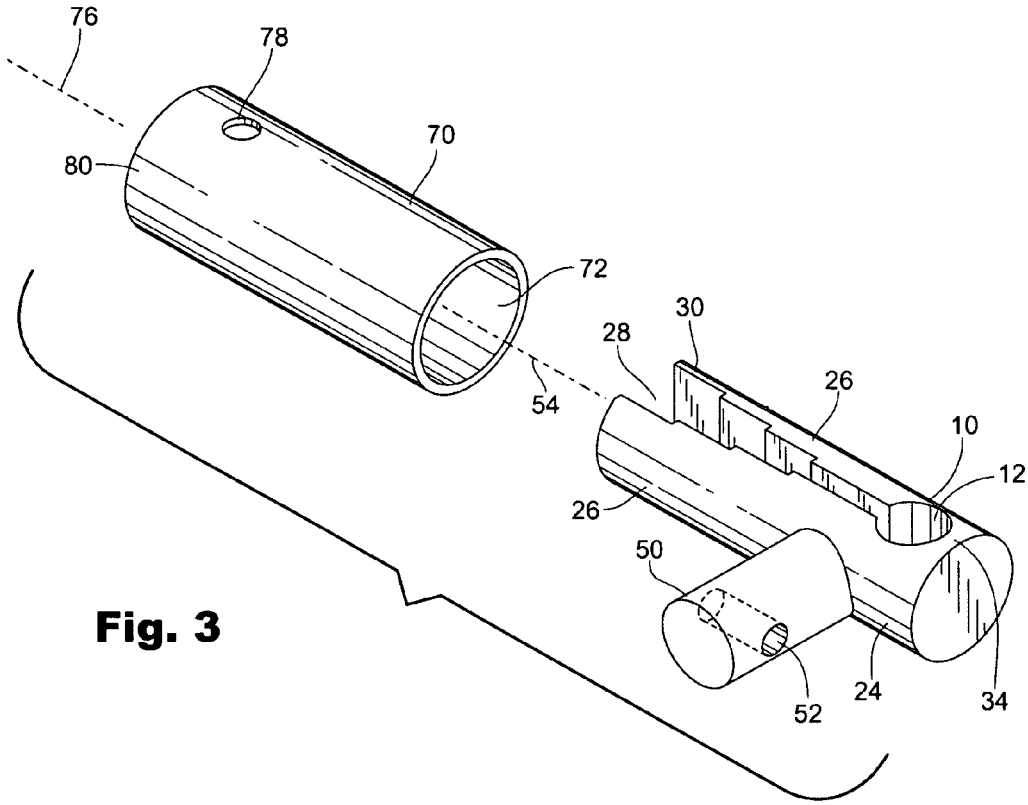
FIG. 3 is a perspective view of one embodiment of the peep site of the present invention, employing a mount with a slot dividing the mount into opposing legs, and also showing a peep site member with a peep site hole, the member extending radially from the mount. Also shown in alignment for receiving the mount legs is a plug that closes the mount when a bow string is installed in the mount hole. The plug shows a hole through the other plug end through which an elastic string passes in securing one end of the string to the plug.
Figure 4:
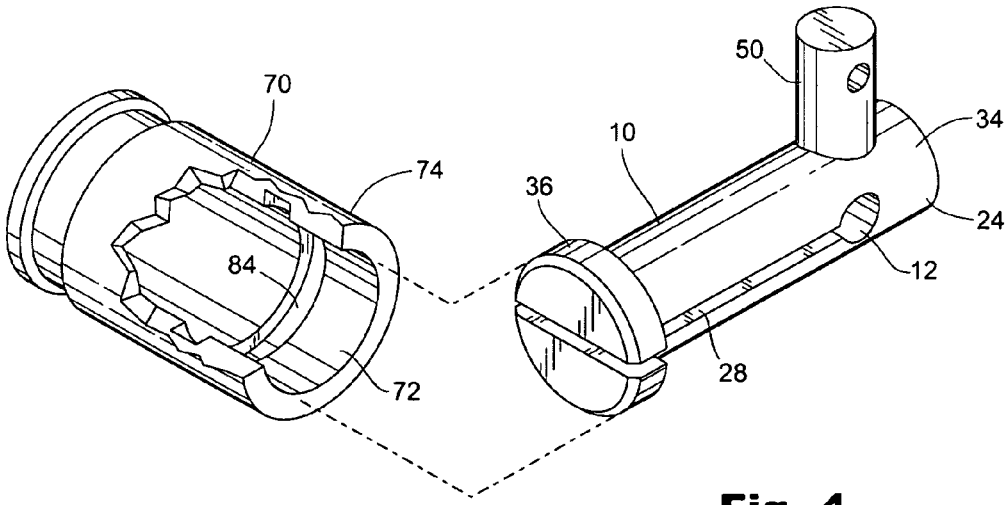
FIG. 4 is a perspective view of the peep site with a cut-away portion in an alternate embodiment showing a mount having a lip extending circumferentially about the mount adapted to fit in a matching groove in the plug. The plug is shown with the matching groove about the periphery of the plug bore into which the mount partially fits. The plug is also shown with a groove about its circumference into which an elastic string is looped.
Figure 5:
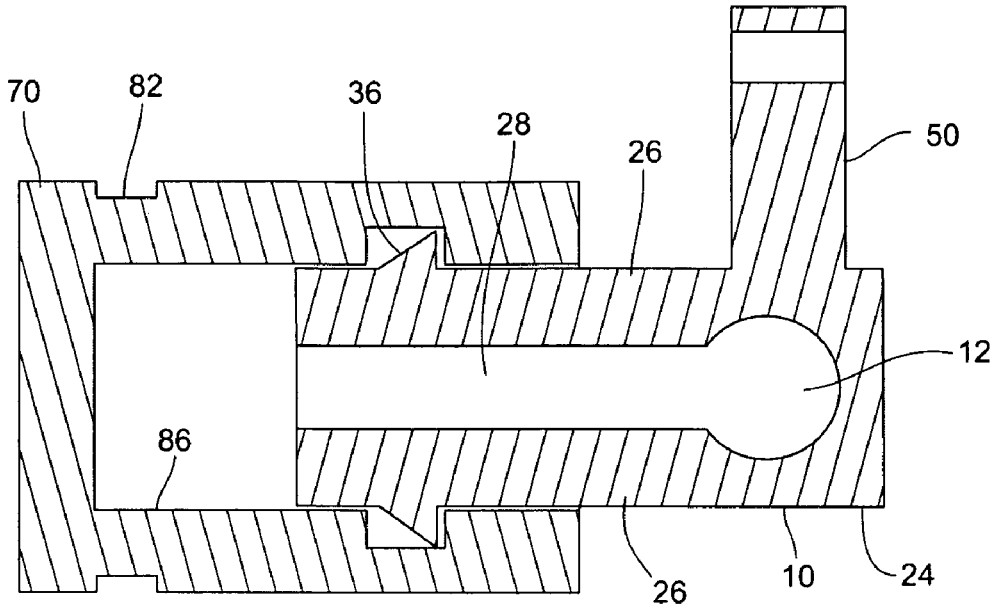
FIG. 5 is a cross-sectional view of the peep site of FIG. 4.
Figure 6:
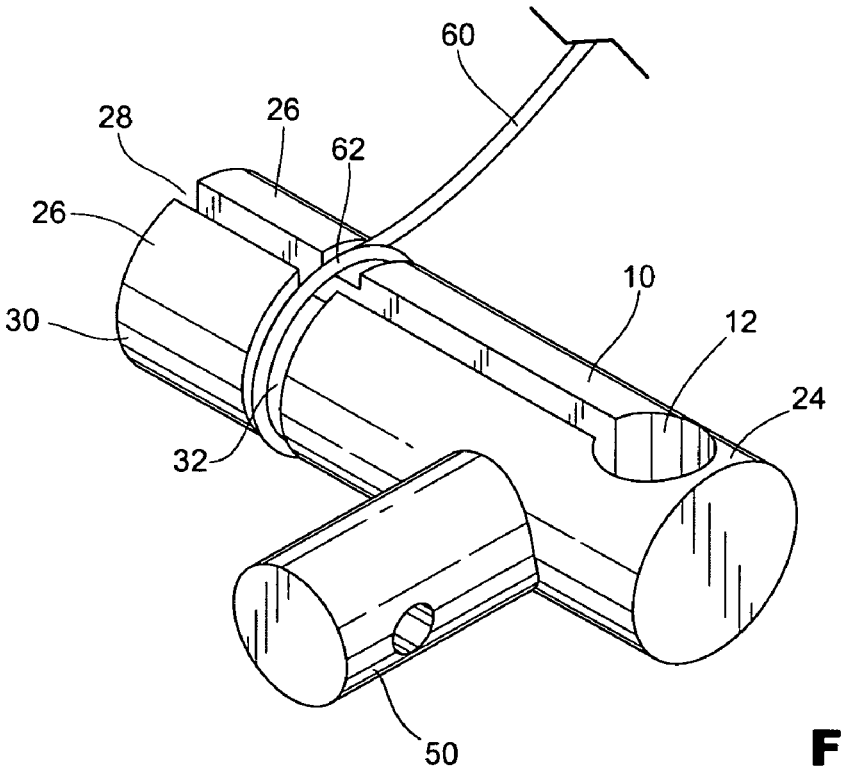
FIG. 6 is another embodiment of the peep site of the present invention, showing a mount that does not require a plug, with the slot closed by the elastic string wrapped in a groove about the mount after the mount is inserted over a bow string.
Figure 7:
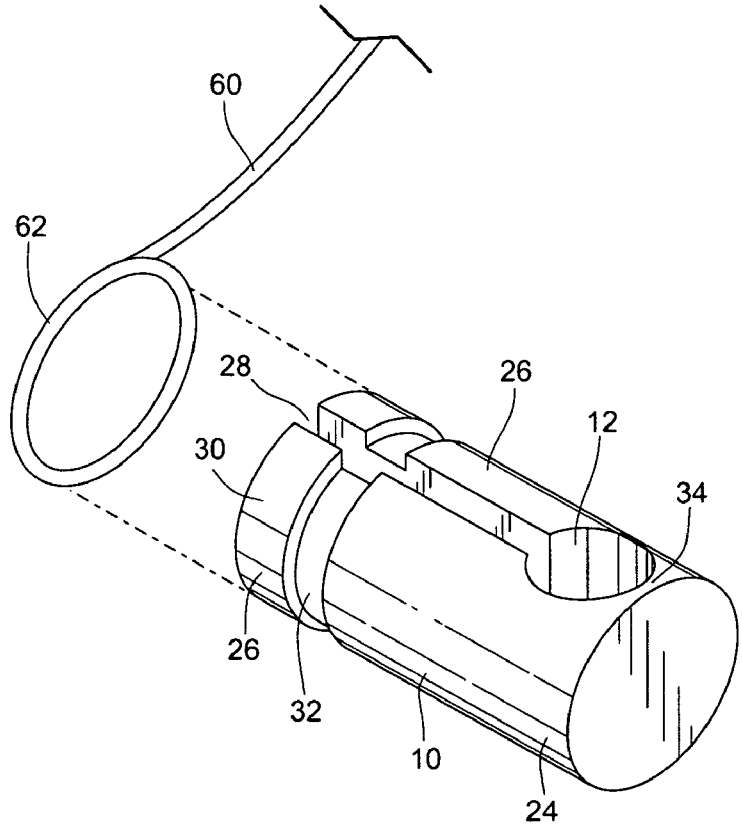
FIG. 7 is a perspective view of another embodiment of the plug that may close the mount, showing a groove circumferentially around the plug. A bow string is also shown aligned in a loop that may fit tightly in the plug groove.
Figure 8:
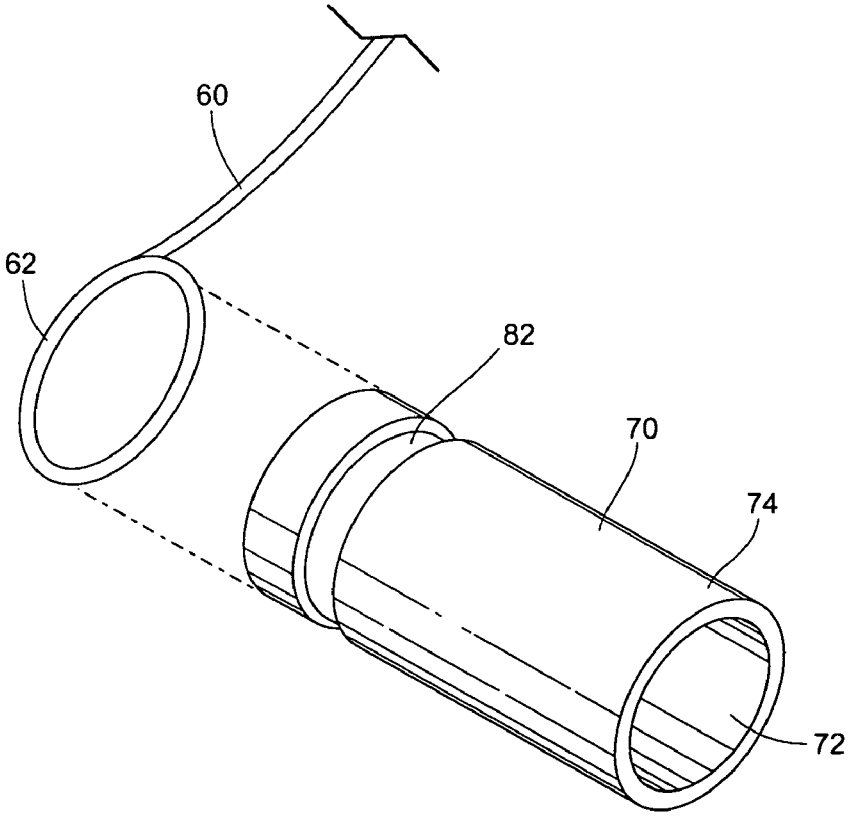
FIG. 8 is a perspective view of an alternate embodiment of a plug, shown with a bore groove about its circumference.
Figure 9:
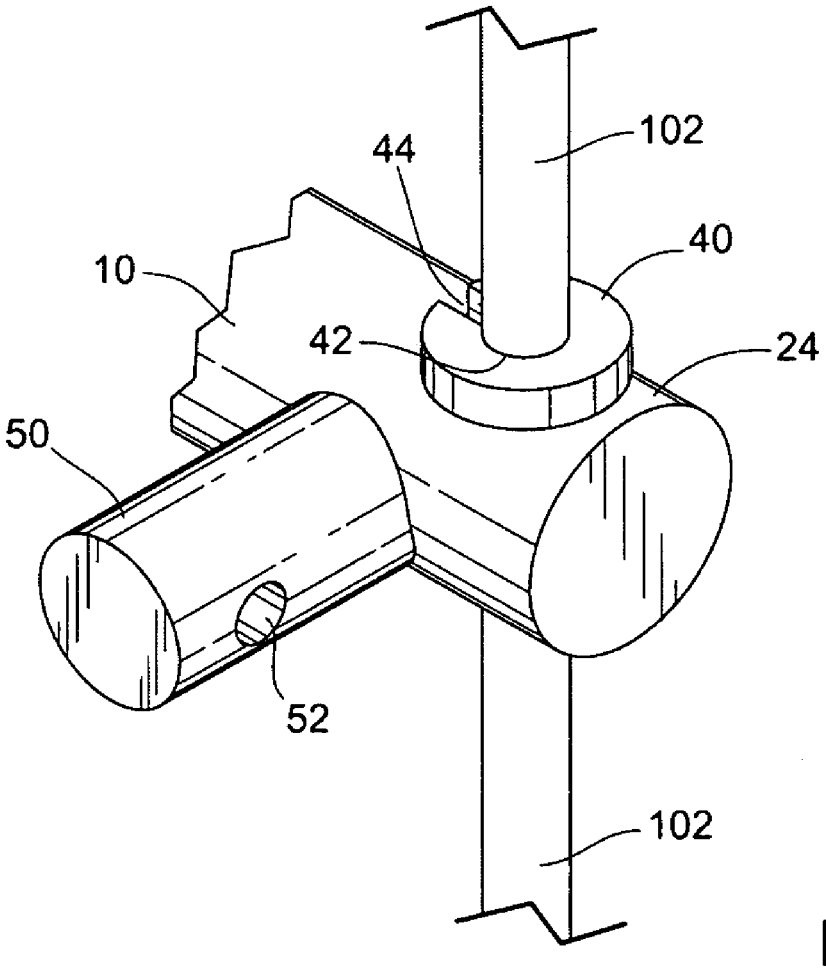
FIG. 9 is a perspective view of a clip that is inserted firmly, that is, not slidably, onto the bow string at a preferred location. Shown abutted against the clip from its underside is the peep site mount. A bow string is shown passing through both the clip and the mount.

The peep site of the present invention mounts to an archery bow 100 and bow string 102 for aiming an arrow 104 loaded therebetween. It comprises a cylindrical mount 10 that has a mount hole 12 transversely through the mount 10 at a first end 24 and two opposing legs 26 obtained by a slot 28 from a mount second end 30 that extends axially through the mount 10 to the mount hole 12. It thus divides the mount 10 from the mount second end 30 to the mount hole 12 such that a bow string 102 smaller than both the slot 28 and the mount hole 12 is receivable through the mount slot 28 and into the mount hole 12 such that the bow string 102 can slide freely in the mount hole.

A string C-shaped clip 40 has a clip hole 42 and clip slot 44 through which the bow string 102 can pass into the clip hole 42. The clip hole 42 is slightly smaller than the bow string 102 and the clip slot 44 is smaller than the clip hole 42. The clip 40 is inserted over the bow string 102 by flexing the clip 40 open such that the bow string 102 can slip through the clip slot 44 and into the clip hole 42. Thus when the clip 40 is released with the bow string 102 in the clip hole 42 it secures to the bow string 102.

A peep site member 50 extends radially from the mount 10 near the mount first end 24 with a peep sight hole 52 approximately parallel to a mount longitudinal axis 54 through which a user views and aligns a target 100 with an arrow 104 set in the bow 100 and the bow string 1-2 in the normal manner and function of a bow and arrow.

An elastic string 60 with an elastic string first end 62 is secured about the mount 10 closing the mount slot 28 to contain the bow string within the mount slot 28. The elastic string 60 is secured to the bow 100 at second string end 64. With the string clip 40 is positioned on the bow string 102, when the bow string is pulled back fully in a bow cocked state ready to shoot an arrow 104 the mount 10 slides on the bow string 102 into abutment with the string clip 40. Typically, but not necessarily, the string clip 40 is positioned on the bow string such that when the mount abuts with the string clip 40 the elastic string 60 is approximately parallel to the arrow 104. Thus, the elastic string 60 stretches as the bow string 102 is pulled back, pulling the mount 10 into a plane defined by the bow string 102 and the bow 100 which aligns the peep site hole 52 parallel to the arrow 104.

In one embodiment, the elastic string first end 62 is tightly looped into a mount groove 32 circumferential around the mount legs 26, securing the elastic string 60 to the mount 10 within the mount slot 28, thus preventing the elastic string 60 from sliding off the mount 10 when the elastic string 60 is stretched.

In another embodiment, a plug 70 has a plug bore 72 in the plug 70 from a plug first end 74 along a plug longitudinal axis 76. The plug bore 72 receives the mount legs 26 therein until the mount legs 26 are held in the plug bore 72. The plug bore 72 thus closes the mount slot 28 to contain the elastic string first end 62 received therein. The mount legs 26 are urged together as they are inserted into the plug bore 72 with resilient flexure. Typically, the mount first end 24 comprises a line of flexure 34 such that the mount legs 26 can resiliently flex about the line of flexure 34. Further, or alternately, the mount legs 26 diminish in thickness from the mount hole 12 to the mount second end 30 such that the amount of flexure of the legs 26 increases from the mount hole 12 to the mount first end 30. The flexure provides a capturing action between the plug 70 and the mount legs 26; that is, with the resilient flexure urging the legs back to a leg rest position, the mount legs 26 in the plug bore 72 are urged against the periphery of the plug bore 72 providing a sufficient sliding friction that the legs 26 are prevented from sliding and are thus captured within the plug bore 72. The plug 70 is thus secured to the mount as it closes the mount slot 28, which contains a bow string 102 in the mount hole 12 and slot 28.

In a further embodiment, the plug 70 has a plug hole 78 transversely through the plug 70 at a plug second end 80 through which the elastic string first end 62 is secured. In an alternate embodiment, the elastic string first end 62 is looped tightly into a plug groove 82 circumferential around the plug 70 preventing the looped elastic string 60 from sliding off the plug 70 when the elastic string 60 is stretched.

In another embodiment, the mount legs 26 further comprise a lip 36 extending radially outward near the mount second end 30 and the plug 70 further comprises a bore groove 84 about the periphery 86 of the plug bore 72 such that as the mount legs 26 are received into the plug bore 72 the lip 36 engages the bore groove 84 thereby preventing the plug 70 from sliding off the mount legs 26 unless the mount legs 26 are urged together sufficiently to release the lip 36 from the bore groove 84.

Having described the invention, what I claim is as follows:

1. A peep sight for mounting to an archery bow and bow string for aiming an arrow loaded therebetween, comprising:

(a) a clip mountable to the bow string having a clip hole through which the bow string may pass without adjustment of position between the bow string and the clip;

(b) a mount with a mount hole through the mount and a mount slot from a mount end through the mount to the mount hole such that a bow string is receivable through the mount slot and into the mount hole such that the mount is slidable in the mount hole;

(c) a peep sight member extending radially from the mount near the mount first end with a peep sight hole approximately parallel to a mount longitudinal axis through which peep sight hole a user views and aligns a target with an arrow set in the bow and the bow string in the normal manner and function of an archery bow and arrow;

(d) an elastic string with a first elastic string end secured about the mount closing the mount slot and containing a bow string therein and the elastic string secured to the bow on a second elastic string end, the string clip being positioned on the bow string such that when the bow string is pulled back to a bow cocked state ready to shoot an arrow the mount slides on the bow string into abutment with the string clip under pull of the elastic string, the clip being positioned on the bow string such that the elastic string is approximately parallel to the arrow, the elastic string stretching as the bow string is pulled back, pulling the mount into a plane defined by the bow string and the bow thereby aligning the peep sight hole parallel to the arrow.

2. The peep sight of claim 1 further comprising a mount groove circumferential around the end into which the elastic string first end is looped in securing the elastic string to the mount, preventing the elastic string from sliding off the mount when the string is stretched.

3. The peep sight of claim 1 further comprising a plug having a plug bore in the plug from a plug first end along a plug longitudinal axis, the plug bore receiving the mount end until the mount end is held in the plug bore thereby closing the mount slot to contain the bow string received therein.

4. The peep sight of claim 3 wherein the mount end comprises a pair of opposed legs on each side of the slot joined at a line of flexure such that the legs can flex about the line of flexure, the legs being urged together as they are received into the plug bore with resilient flexure, the flexure providing a capturing action between the plug and the mount legs.

5. The peep sight of claim 4 wherein the mount legs diminish in thickness from the mount hole to the mount second end such that the legs bend increasingly more from the mount hole to the mount first end.

6. The peep sight of claim 3 wherein the first elastic string end is secured to the plug.

7. The peep sight of claim 6 further comprising a plug groove circumferential around the plug into which groove the elastic string first end is looped, preventing the looped string from sliding off the plug when the elastic string is stretched.

8. The peep sight of claim 6 wherein the plug comprises a plug hole transversely through the plug near a plug second end, wherein the first elastic string end is secured to the plug through the plug hole.

9. The peep sight of claim 3 wherein the end further comprises a lip extending outward near the mount end and the plug further comprises a bore groove about the periphery of the bore such that as the end is received into the bore the lip engages the bore groove thereby preventing the plug from sliding off the end.

10. The peep sight of claim 9 wherein the lip releasably engages the bore groove.

11. A peep sight for mounting to an archery bow and bow string for aiming an arrow loaded therebetween, comprising:

(a) a clip mountable to the bow string having a clip hole through which the bow string may pass without adjustment of position between the bow string and the clip;

(b) a mount with a mount hole through the mount and a mount slot from a mount end through the mount to the mount hole such that a bow string is receivable through the mount slot and into the mount hole such that the mount is slidable in the mount hole;

(c) a peep sight member extending radially from the mount near the mount first end with a peep sight hole approximately parallel to a mount longitudinal axis through which peep sight hole a user views and aligns a target with an arrow set in the bow and the bow string in the normal manner and function of an archery bow and arrow;

(d) an elastic string with a first elastic string end secured about the mount closing the mount slot and containing a bow string therein and the elastic string secured to the bow on a second elastic string end under pull of the elastic string, the clip being positioned on the bow string such that when the bow string is pulled back to a bow cocked state ready to shoot an arrow the mount slides on the bow string into abutment with the clip, the clip being positioned on the bow string such that the elastic string is approximately parallel to the bow string, the elastic string stretching as the bow string is pulled back, pulling the mount into a plane defined by the bow string and the bow thereby aligning the peep sight hole parallel to the arrow;

(e) a mount groove circumferential around the mount end into which the first elastic string end is looped in securing the elastic string to the mount, preventing the elastic string from sliding off the mount when the string is stretched;

(f) a plug having a plug bore in the plug from a plug first end along a plug longitudinal axis, the plug bore receiving the mount end until the mount end is held in the plug bore thereby closing the mount slot to contain the bow string received therein, wherein the slot divides the mount end into opposing mount legs, the mount legs bending as they are being urged together as they are received into the plug bore with resilient flexure, the flexure providing a capturing action between the plug and the mount legs.

12. The peep sight of claim 11 wherein the mount legs diminish in thickness from the mount hole to the mount second end such that the legs bend increasingly more from the mount hole to the mount first end.

13. The peep sight of claim 11 wherein the first elastic string end is secured to the plug.

14. The peep sight of claim 13 further comprising a plug groove circumferential around the plug into which groove the first elastic string end is looped, preventing the looped string from sliding off the plug when the elastic string is stretched.

15. The peep sight of claim 13 wherein the plug comprises a plug hole transversely through the plug near a plug second end, wherein the first elastic string end is secured to the plug through the plug hole.

16. The peep sight of claim 13 wherein the mount legs further comprise a lip extending outward near the mount second end and the plug further comprises a bore groove about the periphery of the bore such that as the mount legs are received into the bore the lip engages the bore groove thereby preventing the plug from sliding off the mount legs unless the legs are urged together thereby releasing the engagement of the lip with the bore groove.

17. A peep sight for mounting to an archery bow and bow string for aiming an arrow loaded therebetween, comprising:

(a) a clip mountable to the bow string having a clip hole through which the bow string may pass without adjustment of position between the bow string and the clip;

(b) a mount with a mount hole through the mount and a mount slot from a mount end through the mount to the mount hole such that a bow string is receivable through the mount slot and into the mount hole such that the mount is slidable in the mount hole, wherein the slot divides the mount end into opposing mount legs;

(c) a peep sight member extending radially from the mount near the mount first end with a peep sight hole approximately parallel to a mount longitudinal axis through which peep sight hole a user views and aligns a target with an arrow set in the bow and the bow string in the normal manner and function of an archery bow and arrow;

(d) an elastic string with a first elastic string end secured about the mount closing the mount slot and containing a bow string therein and the elastic string secured to the bow on a second elastic string end, the string clip being positioned on the bow string such that when the bow string is pulled back to a bow cocked state ready to shoot an arrow the mount slides on the bow string into abutment with the string clip under pull of the elastic string, the clip being positioned on the bow string such that the elastic string is approximately parallel to the arrow, the elastic string stretching as the bow string is pulled back, pulling the mount into a plane defined by the bow string and the bow thereby aligning the peep sight hole parallel to the arrow, and further comprising a mount groove circumferential around the legs into which the elastic string first end is looped in securing the elastic string to the mount, preventing the elastic string from sliding off the mount when the string is stretched;

(e) a plug having a plug bore in the plug from a plug first end along a plug longitudinal axis, the plug bore receiving the mount legs until the mount legs are held in the plug bore thereby closing the mount slot to contain the bow string received therein, wherein the mount legs are received into the plug bore, the mount legs bending as they are being urged together as they are received into the plug bore with resilient flexure, the flexure providing a capturing action between the plug and the mount legs, wherein the mount legs diminish in thickness from the mount hole to the mount second end such that the legs bend increasingly more from the mount hole to the mount first end; wherein the elastic string first end is secured to the plug.

18. The peep sight of claim 17 further comprising a plug groove circumferential around the plug into which groove the first elastic string end is looped, preventing the looped string from sliding off the plug when the elastic string is stretched.

19. The peep sight of claim 17 wherein the plug comprises a plug hole transversely through the plug near a plug second end, wherein the first elastic string end is secured to the plug through the plug hole.

20. The peep sight of claim 17 wherein the mount legs further comprise a lip extending outward near the mount end and the plug further comprises a bore groove about the periphery of the bore such that as the mount legs are received into the bore the lip engages the bore groove thereby preventing the plug from sliding off the mount legs unless the legs are urged together thereby releasing the engagement of the lip with the bore groove.

* * * * *